US007990261B2

(12) United States Patent
Leach et al.

(10) Patent No.: US 7,990,261 B2
(45) Date of Patent: Aug. 2, 2011

(54) SPEAKER CIRCUIT RESIDENT NOTIFICATION APPLIANCES

(75) Inventors: Jonathan W. Leach, Killingworth, CT (US); Andrew G. Berezowski, Wallingford, CT (US); Jesse J. Otis, North Haven, CT (US)

(73) Assignee: Honeywell International Inc., Morristown, NJ (US)

( * ) Notice: Subject to any disclaimer, the term of this patent is extended or adjusted under 35 U.S.C. 154(b) by 346 days.

(21) Appl. No.: 12/041,453

(22) Filed: Mar. 3, 2008

(65) Prior Publication Data

US 2009/0219162 A1 Sep. 3, 2009

(51) Int. Cl.
*G08B 29/00* (2006.01)

(52) U.S. Cl. ..... 340/509; 340/533; 340/286.02
(58) Field of Classification Search ..... 340/555
See application file for complete search history.

(56) References Cited

U.S. PATENT DOCUMENTS 4,881,058 A * 11/1989 Berry, III ..... 340/326
2007/0035407 A1* 2/2007 Capowski et al. ..... 340/679
* cited by examiner

*Primary Examiner* — Brian A Zimmerman
*Assistant Examiner* — Sara Samson
(74) *Attorney, Agent, or Firm* — Husch Blackwell

(57) ABSTRACT

Both notification appliances and speakers usable to broadcast verbal messages into a region can be coupled to common signal and power providing communication lines. Composite output modules can include speakers, horns, and strobe lights, all without limitation, which can be independently driven and controlled from a common pair of lines.

20 Claims, 6 Drawing Sheets

SPEAKER CIRCUIT RESIDENT NOTIFICATION APPLIANCES

FIELD

The invention pertains to audible and visual alarm indicating output devices. More particularly, the invention pertains to output devices which can be coupled to regional public address or verbal notification systems.

BACKGROUND

Fire alarm system complexity and cost are directly related to the number of different circuits (wires) needed to implement a system design. Reducing the types of circuits can reduce overall system cost, complexity, and maintenance.

Currently in notification systems, the use of speakers for audio messages and strobes for visual alarm indication requires that two separate risers are run to power the two systems (audio and visual). This doubles the material and adds labor cost for running wires and making connections to the audio and visual notification appliances. One approach to more flexible verbal messaging has been disclosed in U.S. patent application Ser. No. 11/626,971 filed Jan. 25, 2007 entitled "Speaker Control Via Audio Connection" and assigned to the Assignee hereof. The '971 application is incorporated herein by reference.

There is thus a continuing need to reduce the complexity and cost of such systems. Preferably such reductions could be achieved while still providing choices as to where such appliances could be installed as well as providing quick and convenient access to system wiring.

DETAILED DESCRIPTION

Figure 1:
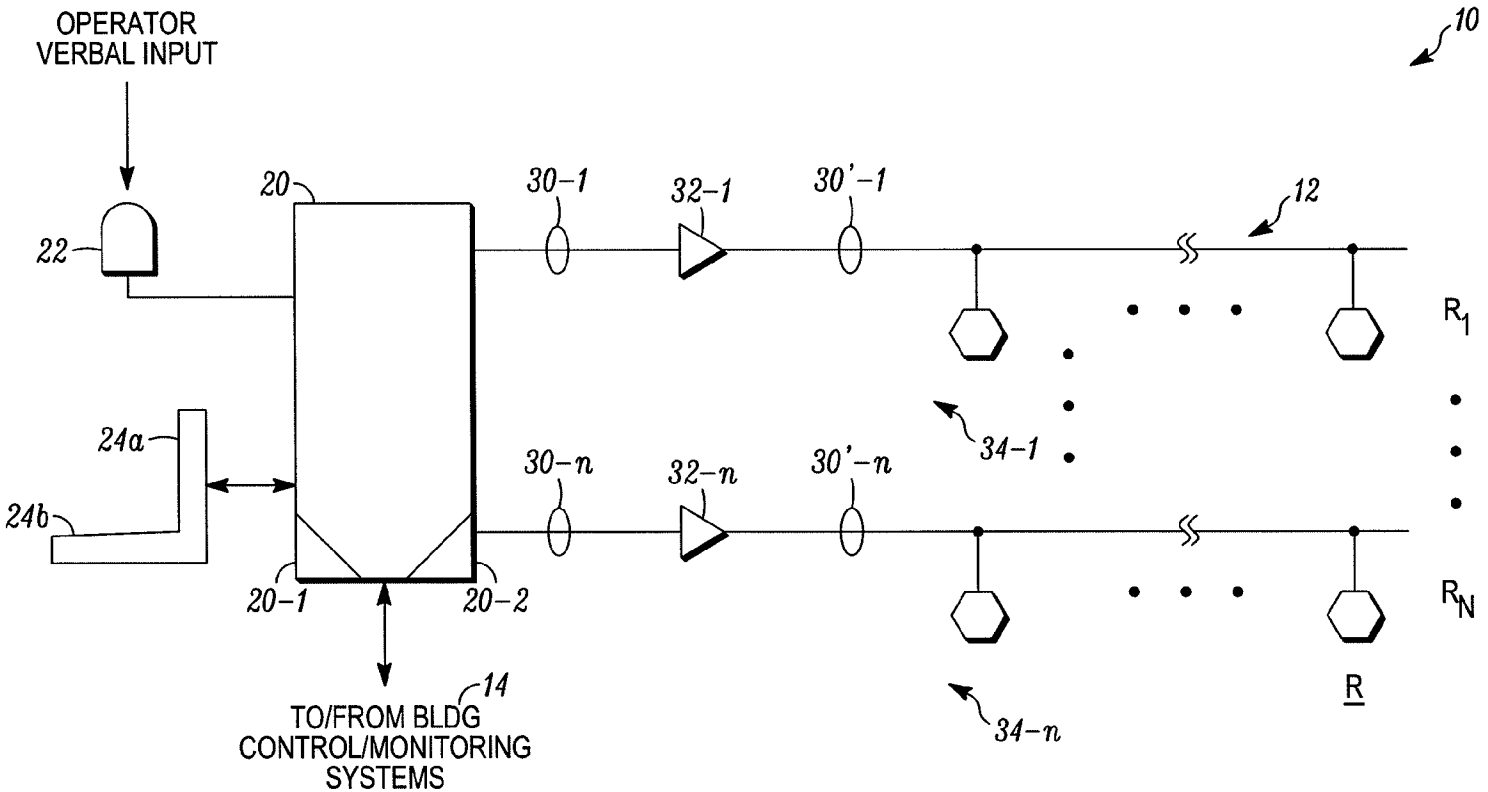
FIG. 1 is an overall diagram of a system which embodies the present invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of this invention help alleviate the above noted problems by enabling notification appliances, such as strobes and horns, to be powered and controlled by a single pair of wires also carrying voice or audio signals. This eliminates the need for separate notification appliance circuits (NACs) and special power supplies or fire panels with these output circuits.

A notification appliance is a device, such as a horn, strobe, or other audio or visual device used to attract attention or otherwise notify an individual or individuals of an event.

Typically these devices reside on separate circuits (a "NAC" circuit), and need dedicated power and control signals to make them work.

Embodiments of this invention remove the horn, strobe, or other notification appliances from a dedicated circuit and enable them to share speaker circuit wiring. Such wiring might be part of a public address system installed in a region of interest. Such systems can be part of or coupled to ambient condition monitoring systems, for example, fire detection and alarm systems.

In one aspect of the invention, the power for the notification appliance is obtained by extracting some energy from the signal on the shared circuit, either from an audio signal or a non-audible signal, which could be a DC offset between the circuit conductors. That energy is used to power the circuitry controlling the activation of the notification appliance, and to power the appliance itself.

In another aspect, local control circuitry recognizes commands delivered via the shared circuit. These commands are used to activate the integral notification appliance, to control its intensity and to synchronize one notification appliance with others. The control circuitry manages load requirements so that load demand variations do not create audible output signals on the shared circuit.

An associated audio amplifier contains circuitry that issues signals to control each notification appliance module individually or in groups. Control signals for example, could be analog, such as a DTMF tone or other audible signal, a signal above the audible range, a signal below the audible range, a DC bias across the two wires, or any other signal.

The notification appliance in the module on the shared circuit may require large amounts of power relative to the speakers on the shared circuit. It may consume this power in surges. This is particularly true, in the case of a strobe light, which pulses periodically. Depending on the nature of the pulses, they may be audible on the audio circuit and may cause reduced audio signal intelligibility.

To minimize unwanted load fluctuations the module can contain a load-controlling device, (such as but not limited to, a digital potentiometer, series element, or current source), regulated so that load-demand disturbances on the shared circuit do not fall within the audio spectrum. Regulation might be achieved through the control circuitry containing a low-pass filter with current sensing, or soft-start circuitry.

Embodiments of the invention could be packaged as single module that includes the notification appliance, terminals for connection to a separate notification appliance, one or more speakers or one or more notification appliances or packaged as a device which provides connections for separate speakers or notification appliances, or any combination thereof.

Embodiments of this invention will enable connection of speakers and strobes on a single pair of wires while retaining the integrity monitoring required in emergency systems during the inactive state. The signal on a single pair of wires can be supplied by an amplifier design that is capable of providing audio with a dc bias during non-emergency conditions (enabling background music and verbal paging), and providing DC power for strobes with an AC signal for audio emergency messages during emergency conditions. Speaker/strobe units that limit transients created on provided DC voltage due to the charging and discharging of strobe circuits, while withstanding the DC bias of an audio signal can be coupled to verbal, audio output lines.

In yet another aspect, a controller can include two amplifiers working together, with one creating an AC signal that is inverted. The combination of the two signals can create, for example, a 25 Vrms AC signal for a speaker in a speaker/ strobe module. The two amplifiers will be biased with different supply voltage levels, which will create a controllable DC bias for the outputs of the amplifiers. This bias can be used to power the strobe section of the speaker/strobe module.

During non-emergency states, the output of the amplifier will pass through series capacitors eliminating the DC bias to carry out known forms of line integrity created by the amplifiers and controller circuit monitoring to check the continuity of the wiring. The DC bias that is applied for integrity monitoring will preferably be opposite that of the bias used to power strobes during emergency signaling. This will allow a diode in the speaker/strobe module to block any current draw during integrity monitoring.

During emergency signaling the circuit integrity blocking diode will conduct allowing the power from the amplifier to reach the strobes in the speaker/strobes. The speaker/strobe modules can include a speaker circuit, capacitively coupled to the wiring and a strobe circuit with a diode (reverse biased during the integrity monitoring state), and a low-pass filter. The low-pass filter will reduce any transients created by the strobe firing circuit from passing back to the wiring and affecting the AC audio signal. To synchronize the strobes, a high frequency signal (above the audio range, but within the pass band of the amplifier) can be used, with a detection circuit on the speaker/strobe to sense the trigger.

FIG. 1 illustrates an overall diagram of a system 10 which embodies the invention. System 10 includes an audio announcement system 12 which has been installed in a building or region R of interest. The system 12 can also be in communication with building control and/or monitoring systems 14 of a type known to those of skill in the art. Such systems could include HVAC systems, as well as systems for monitoring for the presence of fire, gas or other alarm conditions.

Audio announcement system 12 includes a control unit 20 which could be implemented with one or more programmed processors 20-1 and executable control software 20-2 as would be understood by those of skill in the art. System 20 also includes an audio input transducer, such as a microphone 22 usable by an operator to couple real-time verbal messages to various subregions R1 . . . Rn of the region R all without limitation.

System 20 could also include a computer driven display unit 24*a* as well as one or more input devices 24*b* which could include keyboards, track balls and the like all without limitation. Control unit 20 can communicate with the operator via display 24 and a graphical user's interface which can provide status information and identify, for example a selected subregion or regions of interest.

Control unit 20 generates various types of output signals, discussed in more detail subsequently, which are coupled via a respective output amplifier such as 32-1 . . . 32-*n* and cables 30'-1 . . . -n to respective audio, verbal and/or visual output modules, members of pluralities 34-1 . . . 34-*n*. Those of skill in the art will understand that the exact location of the amplifiers 32 is not a limitation of the invention. They can be incorporated into unit 20 or displaced therefrom all without limitation.

Figure 2:
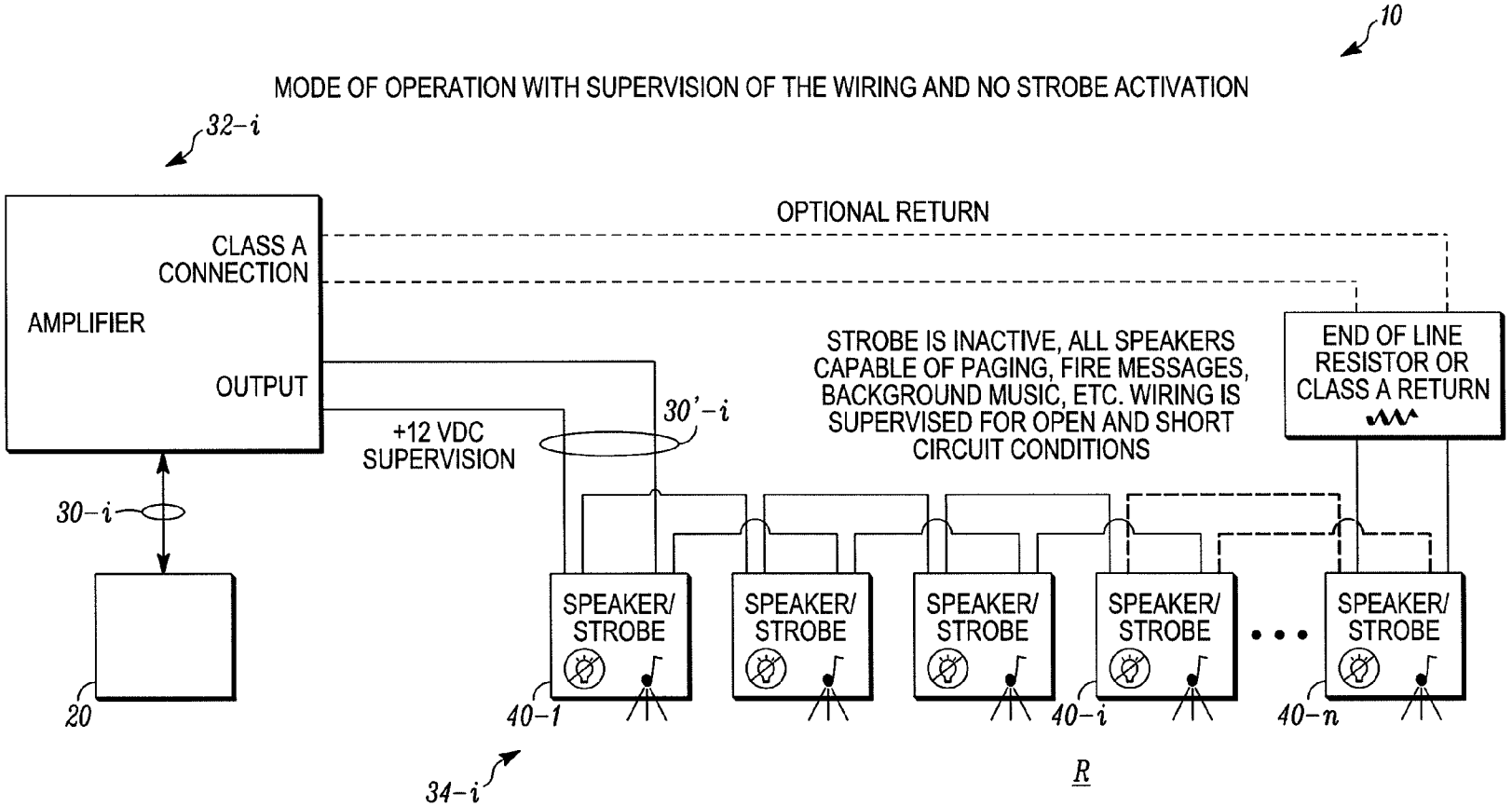
FIG. 2 is a block diagram illustrating more details of the system of FIG. 1 when operating in a non-alarm mode.
Figure 3:
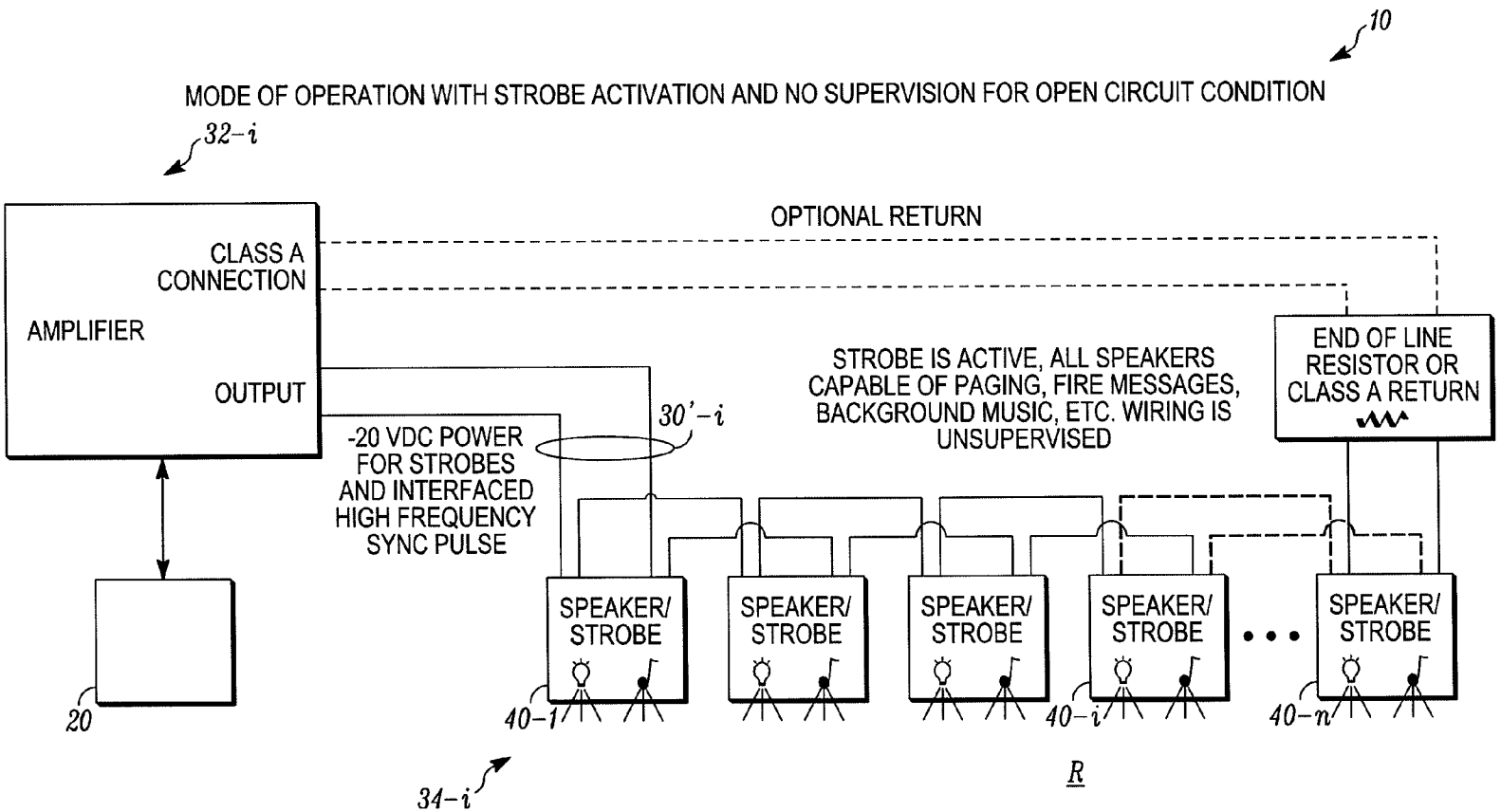
FIG. 3 is a block diagram illustrating more details of the system of FIG. 1 when operating in an alarm indicating mode.

FIGS. 2 and 3 illustrate additional details of the system 10 in two different modes of operation. As illustrated in FIGS. 2, 3 the representative output units 34-*i* which include 40-1, 40-2 . . . 40-*n* can be implemented as combination speaker/strobe modules. Such modules can emit verbal messages, such as announcements, paging, alarm messages, background music and the like, all without limitation, into the region R. Additionally, they can provide non-verbal audio outputs, comparable to those emitted by alarm indicating horns as well as visual alarm indications emitted by strobe lights.

As illustrated in FIGS. 2, 3 outputs from representative amplifier 32-*i* are coupled via the medium or cables 30'-i to the members of the plurality 34-*i*. In FIG. 2, the output signals on the lines 30'-i correspond to a representative 12 volt DC output with indicated polarity enabling the amplifier 32*i* and the associated control unit 20 to monitor or supervise the condition of the wiring 30'-i for open and short circuit conditions as would be understood by those of skill in the art. In the mode of operation illustrated in FIG. 2, the strobe units of the members of the plurality 34-*i* are inactive although the speakers or verbal emitting transducers of each of the units 40-*i* is active and can be used to output real-time messages from the operator, see FIG. 1, or downloaded real-tine or audio messages.

As illustrated in FIG. 3, the amplifier 32-*i* has reversed the polarity of the output voltage on the lines 30'-i to a state indicative of an alarm condition which has been recognized by the associated building monitoring system 14. In the mode of operation illustrated in FIG. 3, the strobe lights in each of the units 40-*i* are active thereby emitting visual alarm indicating outputs. Additionally, the output transducers of each of the units 40-*i* are available for emitting verbal emergency messages in the region R. Alternately, pre-stored or synthetic messages can be also emitted into the region R in response to the detected alarm condition.

Figure 4:
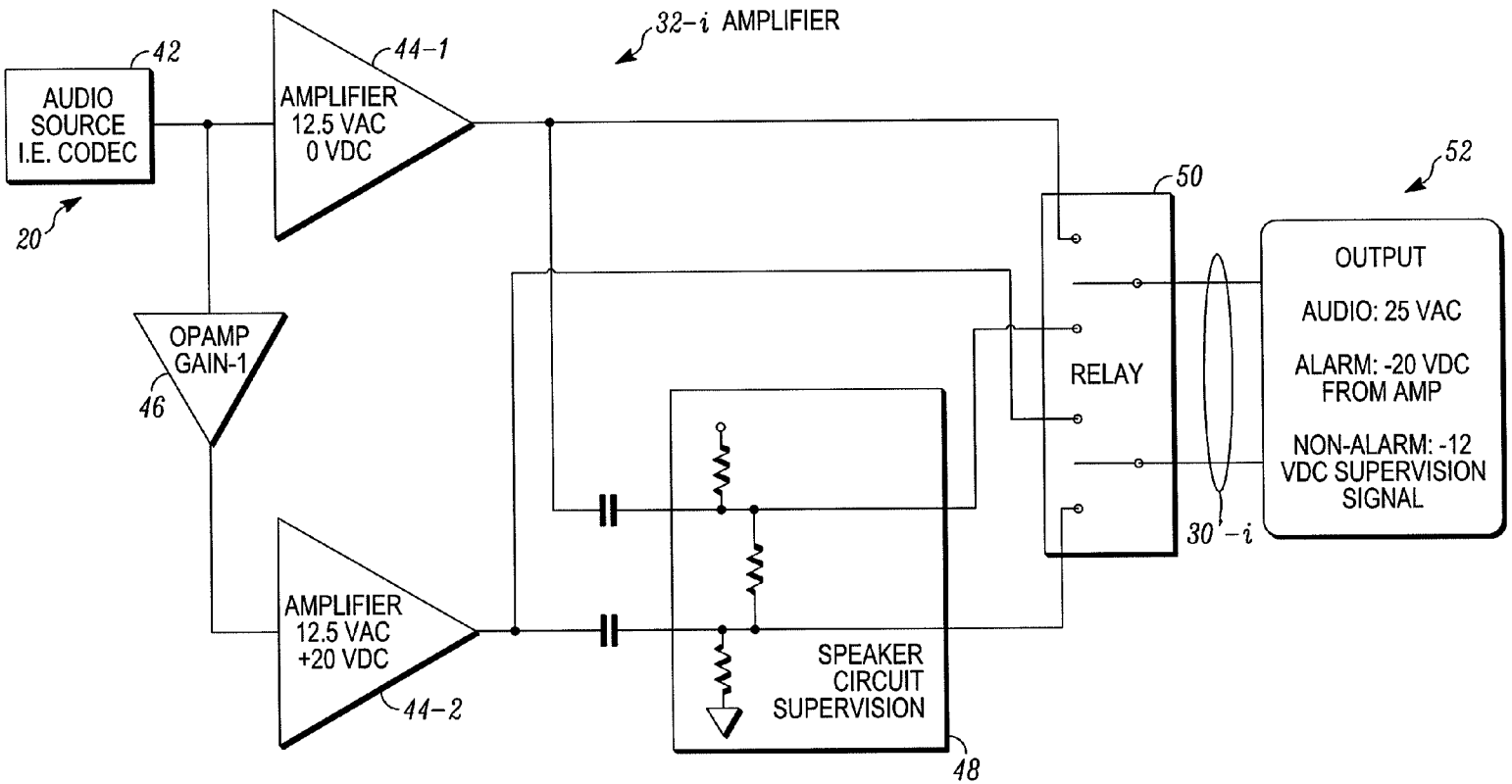
FIG. 4 is a schematic diagram of an amplifier usable in the system of FIGS. 2, 3.

FIG. 4 illustrates various details of representative amplifier 32-*i*. Amplifier 34-*i* can receive audio signals from the system 20 and/or can include an audio source such as CODEC circuitry 42 all without limitation. Amplifier 32-*i* includes two output amplifiers 44-1 and 44-2. Amplifier 44-2 receives inverted audio and/or control signals via inverting operational amplifier 46.

The signals from amplifiers 44-1, -2 are coupled via speaker circuit supervision circuitry 48 to a switching module 50 which can provide a plurality of composite outputs including audio outputs, alarm indicating outputs as well as non-alarm supervisory signals indicated generally at 52, which are coupled via lines 30'-*i* to the modules 40-*i*, as discussed previously relative to FIGS. 2, 3. Amplifier 32-1 also includes supervision circuitry 48 which provides supervisory signals as described above with respect to FIG. 2.

Figure 5:
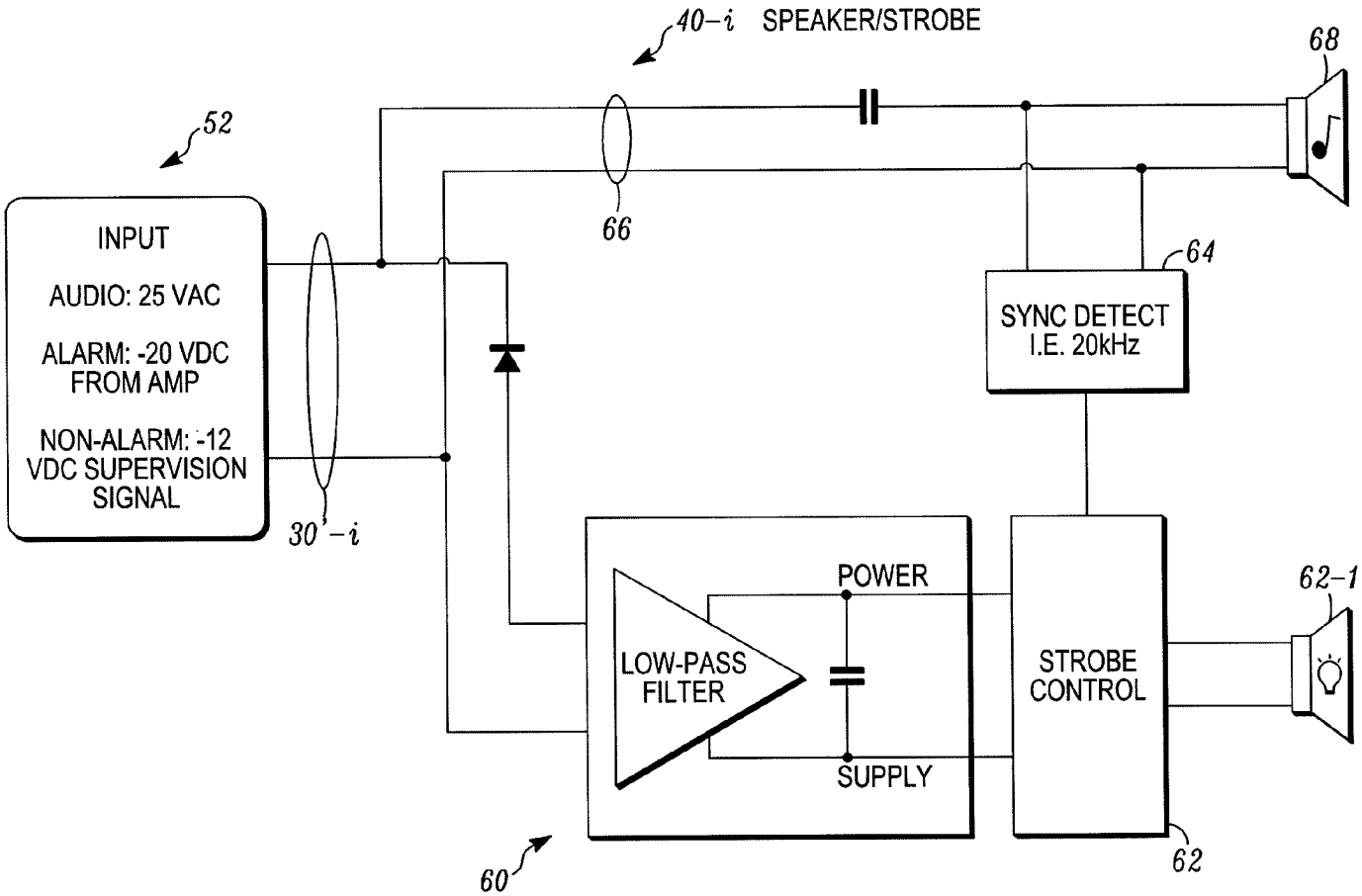
FIG. 5 is a diagram of an audio/visual output module usable in the system of FIGS. 2, 3.

FIG. 5 illustrates details of the speaker/strobe modules 40-*i*. Each of the modules 40-*i*, with reference to FIGS. 2, 3 is coupled the communications medium 30'-*i*, which could be implemented as a two conductor cable. The units 40-*i* include a local low-pass filter/power supply 60, and strobe control circuitry 62.

The strobe control circuitry 62 in turn drives a strobe light or other visual indicating output device 62-1 usable to visually inform individuals in the region R of an alarm condition. The strobe control circuitry 62 is synchronized via detection circuitry 64 which responds synchronization signals intermixed on audio or verbal output signals on lines 66. Each of the units or modules 40-*i* includes a verbal or audio output transducer such as a loudspeaker 68 which can not only emit verbal messages into the region R but could alternately, if desired, also emit audible alarm indicating tones.

Figure 6:
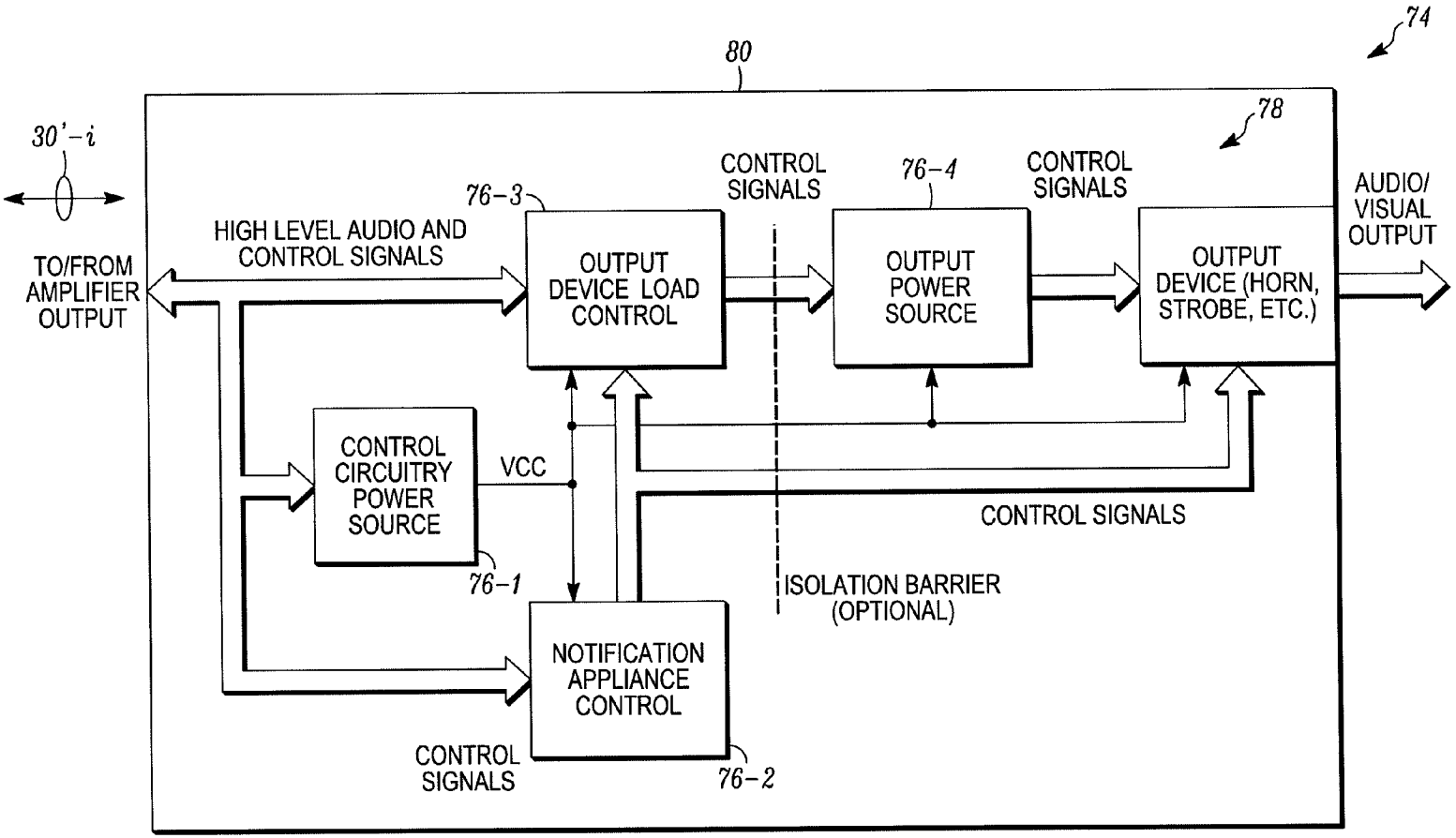
FIG. 6 is a diagram of an alternate output module in accordance with the invention.

FIG. 6 illustrates an alternate form of an output module 74. The module 74 can be coupled to the communications medium 30'-*i* for bidirectional communication with the amplifier 32-*i*. The output module 74 includes a local power supply 76-1 energized from electrical energy supplied by the communications cables 30'-*i*. Received audio and control signals are coupled to notification appliance control circuitry 76-2 as well as output device load control circuitry 76-3.

A local output device power supply 76-4 receives electrical energy from source 76-1. Control signals from the circuitry 76-2, -3 are coupled to one or more output devices indicated generally as 78.

The output devices 78 can include loudspeakers and other forms of verbal output transducers, horns, strobes and the like all without limitation. Unit 74 is carried by a housing 80.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An output module comprising:

a light emitting output element;

a verbal output transducer;

control circuits coupled to the light emitting output element and the verbal output transducer; and a shared interface, coupled to the control circuits, the shared interface having ports to receive electrical energy, audio inputs, synchronization signals, and an alarm indicating input which are coupled to the control circuits, the control circuits couple audio outputs to the verbal output transducer, and control signals to the light emitting output element, wherein the shared interface receives signals with a DC bias during non-emergency conditions to maintain the verbal output transducer in an active state and receives DC power for the light emitting output element and an AC signal for the verbal output transducer during emergency conditions to maintain both the light emitting output element and the verbal output transducer in an active state.

2. A module as in claim 1 which includes circuitry responsive to the alarm indicating input to energize the light emitting output element.

3. A module as in claim 2 which includes light emitting output element control circuitry.

4. A module as in claim 3 which includes synchronization circuitry coupled to the output element control circuitry.

5. A module as in claim 4 where the light emitting output element comprises a triggerable strobe.

6. A module as in claim 5 where the verbal output transducer comprises a speaker to emit verbal messages.

7. A module as in claim 6 where the control circuits couple signals indicative of verbal messages to the speaker.

8. A module as in claim 7 where the verbal messages are coupled to the speaker even in the absence of the alarm indicating input.

9. A module as in claim 8 which includes a housing, the housing carrying the light emitting output element and the verbal output transducer.

10. A module as in claim 9 which includes a power supply, carried by the housing, and activated by the alarm indicating input.

11. An apparatus comprising:

an amplifier coupled to a plurality of audio visual alarm indicating output devices with each of the devices including:

a light emitting output element;

a verbal output transducer;

control circuits coupled to the element and the transducer; and a shared interface, coupled to the control circuits, the shared interface having ports that receive electrical energy, audio inputs, synchronization signals, and an alarm indicating input which are coupled to the control circuits, the control circuits couple audio outputs to the verbal output transducer, and control signals to the light emitting output element, wherein the amplifier provides signals with a DC bias during non-emergency conditions to maintain the verbal output transducer in an active state and provides DC power for the light emitting output element and an AC signal for the verbal output transducer during emergency conditions to maintain both the light emitting output element and the verbal output transducer in an active state.

12. An apparatus as in claim 11 where the amplifier includes a switching element coupled to the output devices.

13. An apparatus as in claim 12 where the switching element couples at least one of electrical energy audio inputs, synchronization signals, or an alarm indicating signal to the output devices.

14. An apparatus as in claim 13 where the switching element couples a supervisory electrical signal to the output devices in the absence of an alarm indicating signal.

15. An apparatus as in claim 14 where the amplifier couples electrical signals corresponding to verbal outputs to at least some of the output devices.

16. An apparatus as in claim 14 where the amplifier couples the supervisory electrical signal to the output device simultaneously with coupling electrical signals corresponding to verbal outputs to at least some of the output devices.

17. An apparatus as in claim 16 where in the presence of an alarm indicting signal, the switching element couples electrical signals corresponding to verbal outputs to at least some of the output devices.

18. A method comprising:

providing an electrical signal carrying shared medium;

coupling verbal message carrying electrical signals to the shared medium simultaneously with coupling supervisory electrical signals to the shared medium;

providing signals with a DC bias during non-emergency conditions to maintain a verbal output transducer in an active state; and providing DC power for a light emitting and an AC signal for the verbal output element during emergency conditions to maintain the light emitting output element and the verbal output transducer in an active state.

19. A method as in claim 18 which includes coupling alarm indicating electrical signals to the shared medium simultaneously with coupling verbal message carrying electrical signals to the shared medium.

20. A method as in claim 19 where the supervisory signals and alarm indicating signals are DC-type electrical signals of different polarities.

* * * * *